US005820496A

United States Patent [19]

Bergeron

[11] Patent Number: 5,820,496

[45] Date of Patent: Oct. 13, 1998

[54] BACKSTOP SYSTEM FOR MEASURING POSITION, VELOCITY, OR TRAJECTORY

[75] Inventor: Ronald W. Bergeron, Inver Grove Heights, Minn.

[73] Assignee: Sportronics Holdings, Inc., Minneapolis, Minn.

[21] Appl. No.: 870,132

[22] Filed: Jun. 6, 1997

[51] Int. Cl.[6] ..... A63B 69/00

[52] U.S. Cl. ..... 473/455; 73/488; 273/371; 356/28

[58] Field of Search ..... 473/454, 455, 473/456, 151, 152, 153, 154, 155, 156, 190, 191, 192, 199; 273/371, 374, 377; 73/488; 356/28

[56] References Cited

U.S. PATENT DOCUMENTS

| | | | |
|---|---|---|---|
| 2,657,058 | 10/1953 | Mulcahy . | |
| 2,784,001 | 3/1957 | Simjian | 473/156 X |
| 3,157,399 | 11/1964 | Gaudet | 473/455 |
| 3,206,196 | 9/1965 | Jackson . | |
| 3,583,703 | 6/1971 | Brown | 473/456 |
| 4,563,005 | 1/1986 | Hand et al. . | |
| 4,770,527 | 9/1988 | Park | 356/28 |
| 5,046,729 | 9/1991 | Yancey | 473/455 |
| 5,230,505 | 7/1993 | Paquet et al. | 473/455 |
| 5,333,855 | 8/1994 | Silin et al. . | |
| 5,419,565 | 5/1995 | Gordon et al. | 273/374 |
| 5,447,315 | 9/1995 | Perkins | 273/371 |
| 5,566,934 | 10/1996 | Black et al. | 473/455 X |
| 5,602,638 | 2/1997 | Boulware | 473/455 X |

*Primary Examiner*—William H. Grieb
*Attorney, Agent, or Firm*—Larkin, Hoffman, Daly & Lindgren, Ltd.

[57] ABSTRACT

A backstop or target particularly suited for use in athletic applications such as baseball or golf, and which includes a frame from which a flexible net is suspended at its corners and connected to a plurality of linear displacement sensors. As the net is displaced due to the impact of a projectile such as a ball, tension is applied to the cords which in turn move the axially-moveable components of each linear displacement sensor. In one embodiment, the linear displacement sensors utilize a light beam and photoelectric detector to plot the time intervals at which equally-spaced indices on the axially-moveable component pass a predetermined point. This data is used to determine position, velocity, or trajectory of the projectile relative to the initial plane of the net using direct geometric and trigonometric calculations.

18 Claims, 2 Drawing Sheets

BACKSTOP SYSTEM FOR MEASURING POSITION, VELOCITY, OR TRAJECTORY

BACKGROUND OF THE INVENTION

1. Field of the Invention

The present invention relates generally to a backstop or target for measuring and calculating the contact position, velocity, and trajectory of a projectile—such as a baseball thrown by a pitcher—and particularly to such a backstop or target which utilizes a flexible netting and a plurality of linear displacement sensors to determine those characteristics.

2. Description of the Prior Art

A variety of devices have been developed to assist in measuring the accuracy and velocity with which a projectile was delivered toward a target. One noteworthy application for such a device is in the field of athletic training, particularly in analyzing the velocity and position at which a thrown object such as a baseball or softball would cross a plane representing home plate. Such devices could also be adapted or utilized in related evaluations, such as driving a golf ball, throwing a football, shooting a hockey puck, kicking a soccer ball, and so forth.

Several devices for analyzing accuracy or velocity of a sporting good such as a baseball or softball are well known to the art, with representative examples being shown in the references submitted with this specification and noted in the file history.

The simplest devices are backstops having a designated target area defined by a border, shaded-region, cutout, or aperture. Accuracy is determined visually by the person throwing the ball or a bystander such as a coach when the ball contacts the target area or passes through the aperture. Some backstops utilize a spring-loaded net to return the ball to the thrower, however such devices rarely work effectively at conventional pitching distances even if the ball hits the "sweet spot," and they inherently train a pitcher to aim for the center of the target rather than working on positioning pitches within a larger target area.

More complex electronic devices have been employed including radar guns solely for determining velocity, and systems which utilize an array of light beams and photoelectric sensors or a pressure-sensitive mat or pad to determine velocity or position or both. Systems utilizing pressure-sensitive or piezoelectric mats are dependent upon knowing the precise weight of the ball to determine velocity based on a momentum calculation, and the mats can be relatively expensive. Photoelectric systems can be less expensive, but to determine velocity at least two arrays spaced-apart along the trajectory of the ball must be utilized. Because the horizontal and vertical spacing of the light beams is relatively close, a focused beam or correction for beam overlap must be used, either of which increases cost and complexity of the system. Computation of trajectory at or prior to the point of impact becomes very complex, if the system permits. Other systems, such as golf simulators, focus on forecasting trajectory after the point of impact, however such systems are extremely complex and expensive.

One system of particular interest utilizes a spring-biased net suspended within a frame by a multiplicity of paired linear actuators. Each linear actuator is connected to the net by a thin cord tied to the border of the net adjacent one of the net's filaments, and opposing pairs of linear actuators are thus linked to one another across the net in either the horizontal or vertical direction by the connection between the corresponding cords and filament. When a ball strikes the net, the net deforms and applies tension to the cords. The cords are wrapped around spindles on the linear actuators. The tension on the cords causes the spindles to rotate, thereby producing a voltage or current represented as an analog gain signal proportional to the speed or angular rate at which the spindle rotates. Each spindle is counter-biased with a coil spring to resist rotation due to tension from the deployed cord. The position and velocity of the ball is determined by reading the sets of gain signals to establish the maximum rate of displacement of the net filaments along the axis of the ball's trajectory (i.e., normal to the initial plane of the net).

While such a system is capable of producing accurate position and velocity calculations, it also presents several deficiencies. A large number of linear actuators is utilized (on the order of 24), which means that several gain signals must be sampled, monitored, recorded, filtered, and processed just to determine position and velocity. The timing and sequencing of the signal sampling must be carefully controlled. From a mechanical perspective, the linear actuators are subject to wear and damage, and for maximum precision a correction must be introduced to account for the variable diameter of the spindle as cord is deployed and the effective diameter decreases, thereby affecting the angular rate of rotation. If a net must be replaced, care must be taken to align the connections between the cords and filaments, and ensure that opposing linear actuators are linked to common filaments. This is time consuming, and can interfere with normal use or maintenance by athletes, coaches, or trainers. The linear actuators are themselves expensive, and the system requires a commensurate bus or interface to handle the data flow, as well as proportionate wiring and harnesses or connections. Computing trajectory at or before the point of impact or forecasting trajectory after the point of impact using such a system is also quite complex, since the gain signals from the linear actuators represent rates of cord deployment and net displacement, rather than actual physical displacement itself. Computing trajectory at or immediately prior to impact is of great assistance in some applications such as evaluating baseball pitching accuracy and effectiveness, and forecasting trajectory after the point of impact is critical for applications such as a golf simulator.

SUMMARY OF THE INVENTION

In contrast to prior art devices, the backstop or target of this invention is capable of determining position, velocity, or trajectory by directly analyzing physical linear displacement of the netting at a minimal number of points utilizing relatively inexpensive and durable mechanisms. The calculations for position, velocity, or trajectory may be made at various levels of complexity depending upon the needs of the particular application, but in any event are extremely rapid. A high degree of redundancy for verifying the accuracy of those calculations is inherently built into the system.

Briefly described, the backstop or target includes a frame from which a flexible net is suspended at its four corners using conventional fasteners. Each corner of the net is connected to a cord which extends internally into the frame and is connected to one end of the axially-moveable component of a linear displacement sensor. As the net is displaced due to the impact of a projectile such as a ball, tension is applied to the cords, which in turn move or displace the axially-moveable components of each linear displacement sensor a distance equal to the displacement of corresponding points on the net. The netting absorbs the projectile's energy as it deforms, bringing the projectile to a stop. The axially-moveable components are free-hanging, and act as counterweights to return the net to its initial position after the projectile is deposited into a receiver.

In one embodiment, the linear displacement sensors utilize a light beam and photoelectric detector to plot the time intervals at which equally-spaced indices on the axially-moveable component pass a predetermined point. This data is used to determine position, velocity, or trajectory of the projectile relative to the initial plane of the net using direct geometric and trigonometric calculations.

DETAILED DESCRIPTION OF THE PREFERRED EMBODIMENTS

The backstop or target for determining position, velocity, or trajectory of a projectile of this invention are illustrated in FIGS. 1–7, and referenced generally therein by the numeral 10. The backstop system 10 and its method of use are referred to simply as the backstop system 10 for convenience, and one representative embodiment is depicted and discussed in detail in the context of evaluating characteristics of a pitched baseball. It will be readily appreciated by those skilled in the art that the same or a suitably modified or adapted system may be utilized in a wide variety of other sporting or athletic applications—such as driving a golf ball, throwing a football, shooting a hockey puck, kicking a soccer ball, and so forth—as well as non-sporting or non-athletic applications. Furthermore, while one representative configuration of the structure, components, and mechanisms of this system have been described in detail based upon their proven suitability for this application and corresponding advantages in the representative operating environment, it is understood that a wide variety of known and hereafter developed equivalents and alternatives may be substituted for certain components to achieve a similar function and corresponding advantages in this or other operating environments or applications.

Figure 1:
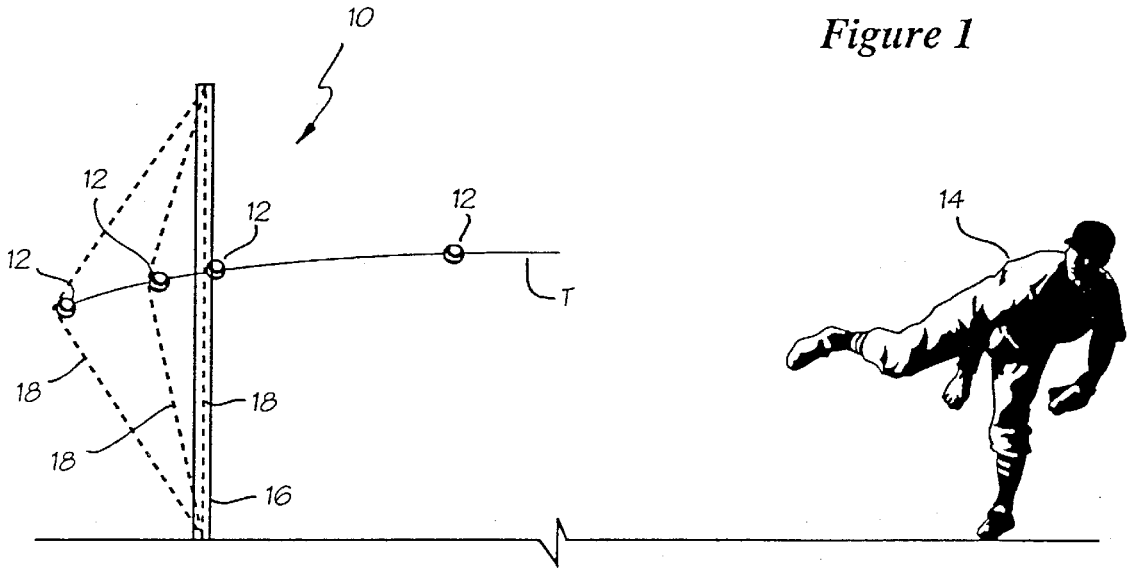
FIG. 1 is a side elevation view diagrammatically depicting a pitcher throwing a baseball at the position-and velocity-measuring backstop of this invention, with the netting shown in the vertical plane and two sequential deformations.
Figure 2:
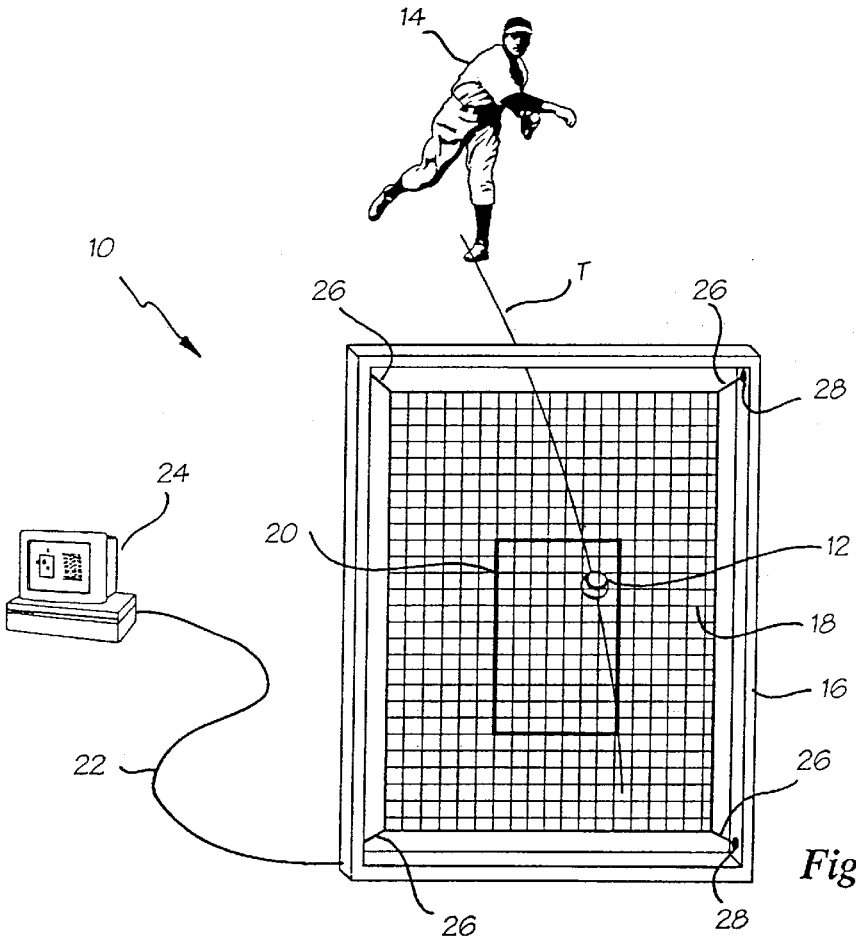
FIG. 2 is a front perspective view depicting the pitcher throwing the baseball at the position-and velocity-measuring backstop of FIG. 1.

Referring particularly to FIGS. 1 and 2, the backstop system 10 is shown in overview with reference to a baseball 12 thrown from a conventional distance by a pitcher 14. The backstop system 10 includes a frame 16 and a suspended netting 18. The frame 16 is supported and stabilized in any suitable manner depending on the conditions and circumstances in which the backstop system 10 will be utilized, and the netting 18 is fabricated from a synthetic or natural cord and border material selected based upon its weight, flexibility, durability, tensile strength, and imperviousness to wear and the natural elements. The netting may optionally be demarked with any desired target zone 20 or reference points to assist in evaluating performance or correlating the system's output or display of measured characteristics to the visual target and results observed by the user. The frame 16 may be padded to prevent ricochets or deflections if the ball 12 does not strike the netting 18, and the ball 12 is preferably deposited into a suitable retrieval mechanism or receiver (not shown) after each pitch rather than rebounding towards the pitcher 14 or in an unintended direction to prevent injury to the pitcher 14 or bystanders.

The electronic components of the backstop system 10 described hereafter are electronically and operatively linked via a cable 22 or wireless connection through the appropriate bus or interface to a microprocessor such as that contained in a personal computer 24, laptop, or similar device capable of recording and processing the data output from the electronic components and performing the requisite calculations desired for the particular application.

Figure 3:
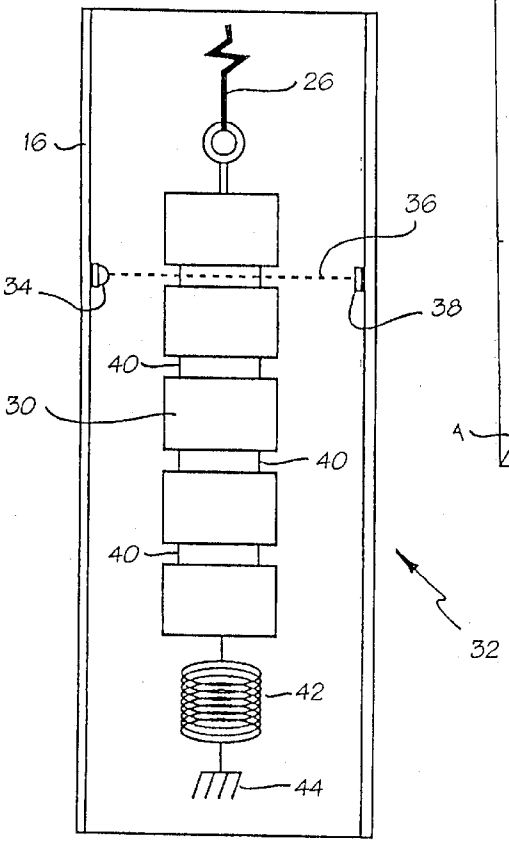
FIG. 3 is a partial cross-section detail view of the upper right comer section of the backstop frame of FIG. 2 diagrammatically depicting the linear displacement sensor S3.

Referring particularly to FIGS. 2 and 3, the netting 18 is suspended at each of its four corners by a cord 26, cable, or similar tensioning element. The netting 18 may be detachably connected to the cord 26 using any conventional clip or fastener (not shown).

Each cord 26 extends through an aperture 28 into the interior of the frame 16, and over a pulley or similar frictionless suspension (not shown) and into alignment with the hollow bore of the frame 16. The end of each cord 26 opposing the netting is connected to the axially-moveable component 30 of a linear displacement sensor 32. In the embodiment shown in FIG. 3, the linear displacement sensor 32 further includes a light-emitting diode 34 which projects a beam 36 incident upon a photoelectric detector 38, that beam 36 either passing or being obstructed by indices 40 or indexing references such as detents or projections spaced equidistantly along the axially-moveable component 30. The axially-moveable components 30 depend from the cord 26 and are generally free-hanging, although their lateral movement or pendulum swinging may be restrained by any appropriate guide (not shown), and the axially-moveable components 30 further act as counterweights to return the netting 18 to its initial, undeformed or undeflected position after the ball 12 has been deposited from the netting 18 into the receiver. It is understood that the linear displacement sensor 32 shown in FIG. 3 represents the mechanism located in the upper right corner of the backstop system 10 as shown in FIG. 2, and that the constituents of the two linear displacement sensors 32 on the opposing side would be mounted in reverse orientation, and that the bottom two linear displacement sensors 32 would include an additional pulley (not shown) or other frictionless guide permitting the cord 26 to be looped upwardly and then downwardly so that the axially-moveable components 30 depend from the cord 26 and are free-hanging.

Alternately, the linear displacement sensors 32 may be located exterior to the frame 16, or may utilize any suitable mechanism for measuring displacement relying upon optical reflectance, magnetic field intensity, RF transpondence intensity, physical contact, ultrasonic, radar, or Doppler measurement, and so forth.

As the ball 12 strikes the netting 18, the netting 18 deforms from its initial plane in a manner depending upon the point of contact of the ball 12 and its relative velocity, trajectory, and spin rate. As the netting 18 deforms, points on the netting 18 are displaced toward the point of impact and corresponding tension is placed on the cords 26, which in turn imparts axial force on the axially-moveable components 30 of each linear displacement sensor 32. The axially-moveable components 30 of each linear displacement sensor 32 move along a path relative to the light-emitting diode 34 and photoelectric detector 38 a distance equal to the displacement of the points on the netting 18, and as each of the indices 40 passes the axial point or plane defined by the light beam 36 a corresponding signal is produced. The signals—which are therefore indicative of the relative or absolute time increments between passage of the indices 40—are fed through an interface (not shown) and into the microprocessor. It has proven suitable to initially process the signals in a single processor 24 or chip disposed at a junction along the cable 22 or mounted in the frame 16, with the output representing time sequenced signals corresponding to four sensors 32 in a format and protocol that can be fed directly into a standard input on a personal computer 24, with the computer 24 utilizing software which reads the input signal and performs the corresponding calculations to determine position, velocity, or trajectory. This configuration has the advantage of rapid diagnosis in the event of a system malfunction, since the microprocessor and interface can be swapped out to verify whether any problem is occurring in the microprocessor or interface themselves, or is alternately the result of a software or hardware failure.

It will be readily appreciated by those of ordinary skill that the linear displacement sensors 32 preferably utilize a uniform triggering event for initiating each signal. For example, in a configuration as shown in FIG. 3, passage of a leading or trailing edge of the projections defining the indices 40 which either allows passage or interrupts the light beam 36 would be a suitable triggering event, and the same triggering event would be used for each of the indices 40 and each of the linear displacement sensors 32. Alternately, the spacing between indices 40 need not be uniform or equidistant, and different triggering events could be used to identify different relative displacements depending upon the requirements of a specific application—such as a rapidly accelerating or decelerating projectile or a non-uniform trajectory—although it has proven simple, cost-effective, and efficient for computational purposes to utilize a configuration as shown and described. In the representative example of a baseball 12 pitched at velocities through the range up to those reached by high school, college, and professional pitchers 14, equidistantly spaced indices 40 at 0.5" increments over a 4" span of the axially-moveable component 30 have proven suitable for determining position, velocity, and baseline trajectory information with an acceptable degree of precision for evaluating pitchers 14 at those levels of competition.

As such, while the netting 18 of the backstop system 10 is actually capable of deforming many inches, to the point where the kinetic energy of the ball 12 has been absorbed and the ball 12 drops from the netting 18 into the receiver, the calculation of pitch characteristics can be accomplished with data obtained within approximately the first 3.5" of detected displacement of the netting 18 from its initial plane. Furthermore, the netting 18 does not need to be stretched tightly to define this initial plane in order to achieve the requisite precision, but may be relatively loosely and flexibly supported. While utilizing data obtained in the first few inches of displacement is suitable for applications such as a baseball 12 being pitched from a distance (and further data collection and analysis would either be of diminishing value or necessary only for very intricate trajectory calculations), tracking displacement and trajectory over a longer period or path may be desirable in other applications, such as a golf simulator. In some application, a more tightly stretched netting 18 may be more advantageous, such as when the netting is suspended at an angled or horizontal orientation for use in a volleyball setting simulator. In other applications, a closer and finer (or wider and courser) spacing between the indices 40 may be desirable to collect data accurately for a faster (or slower) moving projectile, such as an arrow or jai alai ball. Other modification to the various mechanical components, such as the size, maximum displacement, weight, or tension on the netting 18, or length of the region of indices 40 along the axially-moveable component 30 of the linear displacement sensor 32 may be necessary to handle other applications, such as evaluating performance in various track and field competitions such as javelin, hammer, shot put, or discuss which involve very heavy projectiles moving at vastly different speeds. The various adaptations and alterations which may be implemented based upon the underlying concept of this backstop system 10 and the peculiar needs of a given sport or activity are virtually limitless.

In operation, a projectile such as the baseball 12 is thrown into the netting 18, causing it to deform and displace the axially-moveable components 30 of the linear displacement sensors 32 and produce time-based displacement signals as described above. Because the time and displacement values are known for each of the four sensors 32 and can be plotted against one another and interpolated using any convenient and conventional statistical model, it is possible to rapidly determine the actual physical or linear displacement of each cord 20 and each corner of the netting 18 at any one of several selected time intervals following the baseball 12 passing the plane defined by the initial position of the netting 18. That position of that plane may be real or imaginary with respect to the actual location of the netting at the initial time.

The calculation of position, velocity, and trajectory (before or after the inferred point of contact with the plane) can be performed at different levels of complexity, depending upon the requirements imposed by the particular application, the desired precision, and the available assumptions regarding the operating conditions. At a most basic level, position and velocity can be calculated with suitable precision in two-dimensional geometric or trigonometric terms, since data collected in the first 3"–4" of deflection (or linear displacement of the axially-moveable component 30) for a full-sized pitching backstop system 10 measuring on the order of several square feet permits small-sine or small-angle (<5°) assumptions that are well within acceptable error limits even for professional evaluation. Calculations performed in three-dimensional geometric or trigonometric terms are slightly more complex, but can still be performed very rapidly and are subject to the same degree of redundancy and verification. Sequential two- or three-dimensional geometric calculations provide very accurate data regarding velocity and baseline trajectory, and even more complex calculations relying on standard calculus. In addition, offsets for the curvature of a flexible netting 18 may be utilized. The selection of a suitable calculation scheme or set of algorithms depends upon the physical characteristics of the system, the application in which it is employed, and the desired degree of precision necessary for calculating the characteristics being evaluated (or for forecasting trajectory over a particular path or distance).

One representative example of the basis for these types of calculations is discussed below, however it is understood that a wide variety of different analytical models may be employed, and different technicians, mathematicians, or designers will have disparate opinions as to the relative advantages or favorability of various statistical models or methods, algorithms, underlying assumptions, or calculations.

Figure 4:
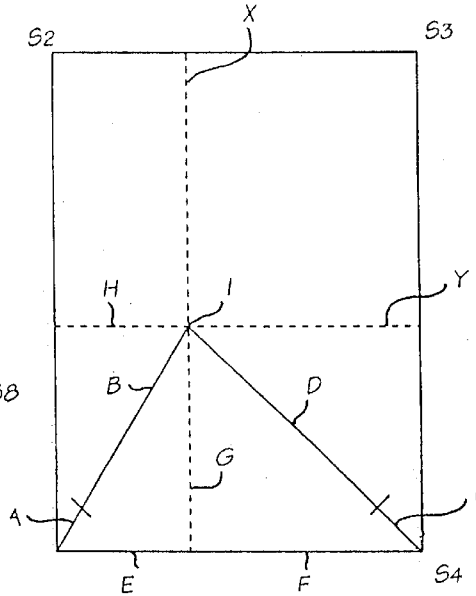
FIG. 4 is a two-dimensional diagram of the X- and Y-axis position plot viewed from a point perpendicular to the plane of the netting.

Referring particularly to FIG. 4, the vectors for a basic trigonometric calculation of X- and Y-axis positions are shown. Assuming a netting 18 bounded by horizontal and vertical sides with linear displacement sensors 32 ($S_1$, $S_2$, $S_3$, and $S_4$) located at each of the corresponding comers, a ball impacting at point I will displace the netting 18 at time $t_1$ a distance A with respect to sensor $S_1$ 32, and a distance C with respect to sensor $S_4$ 32. Using the Pythagorean theorem, it is known that the distances $(A+B)^2+(C+D)^2=(E+F)^2$, where E and F are known distances, but B and D are taken to be indeterminate. (In fact, B and D can be readily inferred based upon the assumption that the ball 12 is moving normal to the plane of the netting 18 and a look-up table could be created for determining X- and Y-axis positions with relative accuracy, but conventional processors can perform the two-or three-dimensional geometric calculations at faster rates and higher precision which makes the use of a look-up table disadvantageous.) In addition, the desired Y-axis position G is to be determined, but it is known that $G2=(A+B)^2-E2=(D+C)^2-F^2$. This middle or right hand portions of this latter equation can be substituted into the general equation above and solved for either A or C with respect to G. The Y-axis position G can therefore be determined by reference to sensors $S_1$ and $S_2$, or $S_3$ and $S_4$. Similarly, the X- axis position H can be determined with reference to sensors $S_1$ and $S_4$, or $S_2$ and $S_3$. Each pairing of sensors 32 thus provides redundancy to verify the X- and Y-axis position of impact point I at any selected time interval $t_1, t_2, t_3, \ldots, t_N$. These calculations reflect two-dimensional calculations superimposed onto the plane of the netting 18, assuming negligible error due to the minimal deflection of the netting 18 immediately following impact. The same calculations can be performed in three-dimensional terms. Alternately, calculations could be performed using diametrically opposing sets of sensors 32 for further verification and extrapolation.

Figure 5:
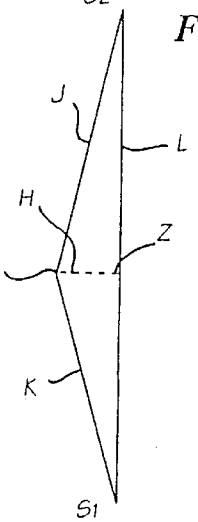
FIG. 5 is a two-dimensional diagram of the Z-axis position plot viewed from a point parallel with the plane of the netting.

Referring to FIG. 5, the vectors for the associated calculation of velocity along the Z-axis are shown. The distance H the ball 12 travels in the Z-axis is represented by the displacement between the location I of the ball 12 and the initial plane, defined for convenience herein as the line connecting sensors $S_1$ and $S_2$ (but any initial position could be selected). Again, the actual distance H is related to variable distances J and K, each of which contains a displacement component equal to the measured displacement at sensors $S_1$ and $S_2$, and the distance between sensors $S_1$ and $S_2$ is also a known constant L. Using the same substitutions and calculations as described above, distance H can be determined, and velocity calculated as distance H divided by elapsed time $t_1$. If desired, the Z-axis distance H can be used as a correction factor in determining X- and Y-axis positions, either as a regression or in future calculations where deflection of the netting 18 begins to approach or exceed a reasonable error threshold.

It may be readily appreciated that determining position and velocity with reference to an initial position of the netting 18 using only a single set of displacement data will be most likely to introduce error, particularly in the case of a soft or highly flexible netting 18 compared with a tightly stretched, relatively inflexible netting 18. The configuration of the backstop assembly 10 and the incremental data sampling method utilized with this backstop assembly 10 provide a convenient and highly effective means for correcting for such factors as the curvature of a flexible netting 18, and any lag between the ball 12 passing the initial plane of the netting 18, contacting the netting 18, and beginning to exert sufficient force on the netting 18 to deform it and tension the cords 26. With a highly-flexible netting 18, slightly greater initial tension will usually be exerted on the upper sensors $S_2$, $S_3$ than the lower sensors $S_1$, $S_4$, and the upper sensors $S_2$, $S_3$ will therefore respond slightly faster to the ball 12 contacting the netting 18. Timing may be sequenced off the first sensor 32 to be actuated, and the signal from the last sensor 32 to be actuated can optionally be ignored without diminishing precision. Actuation of the first sensor 32 is considered to occur when the first "on" or "off" signal responsive to the first of either the leading or trailing edge of the an indexing reference 40 passing the predetermined reference point (in this case the path of the light beam 36) is detected. That signal and its corresponding value (i.e., "on" or "off") initializes the data sequencing and collecting process, and determines what structures of the indices 40 (i.e., leading or trailing edges) are used for detection. Velocity is then calculated using the first or lead sensor 32 signals as the primary factors or variables, with accuracy and redundancy being indicated by comparison with or matching against the signals and computational results obtained from the remaining two or three sensors 32.

As noted above, it is favored to determine position and velocity by performing calculations based upon two or more measured data sets representing incremental movement of the ball 12 after actual contact with the netting 18—and therefore corresponding to the incremental displacement at the point of impact of the netting 18 and points directly linked to the linear displacement sensors 32—rather than relying on a single initial data set observed at some selected time $t_N$ with reference to an artificial initial plane of the netting 18 assumed to be substantially the same as the plane of the sensors 32.

Figure 6:
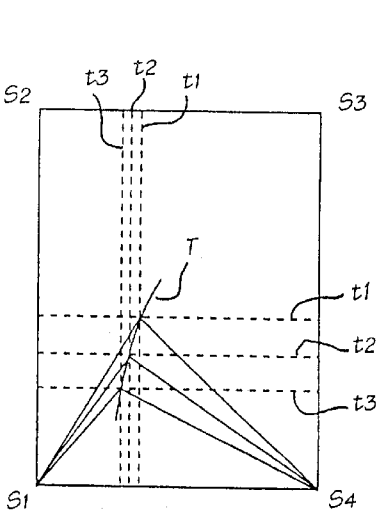
FIG. 6 is a two-dimensional diagram of a series of the X- and Y-axis position plots taken from the perspective of FIG. 4 at specified time increments showing the trajectory of the plotted projectile.
Figure 7:
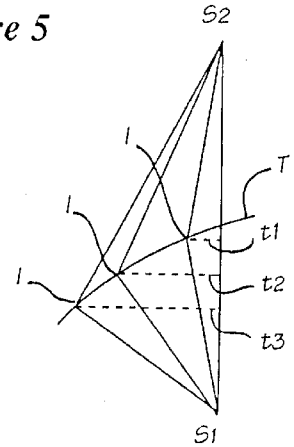
FIG. 7 is a two-dimensional diagram of a series of the Z-axis position plots taken from the perspective of FIG. 5 at specified time increments showing the trajectory of the plotted projectile.

Referring to FIGS. 6 and 7, the use of these basic geometric calculations at several increments to determine baseline trajectory information is shown, in which three samples at times $t_1$, $t_2$, and $t_3$ are plotted against the actual trajectory T of the ball 12. Using the most appropriate statistical model for the application, trajectory of the ball 12 at, before, or after the inferred point of impact with the netting 18 (or the selected initial plane) can be calculated with similar precision. Using incremental changes in X- , Y-, and Z-axis position at a series of intervals immediately after the point of impact allows for a rapid determination of the degree of break reflected in a particular pitch (such as a curve-ball, slider, screwball, split-finger fastball, and so forth) both vertically and horizontally, its position as it crosses home plate or the batter's point of contact, and at the catcher's mitt, thus allowing for a comprehensive evaluation of the effectiveness of a particular breaking pitch. As noted above, the particular calculations adopted for any application of the backstop system 10 of this invention will depend upon the personal preferences of the designer, mathematician, or programmer, the environmental and structural constraints of the particular system, and the intended function or application for which the system will be used.

While the preferred embodiments of the above backstop system 10 have been described in detail with reference to the attached drawings Figures, it is understood that various changes, modifications, and adaptations may be made in the backstop system 10 or its method of operation or range of applications without departing from the spirit and scope of the appended claims.

What is claimed is:

1. A backstop system for determining the velocity or position or both of an article traveling along a path intersecting said backstop system, said backstop system comprising:

a frame member;

a target member mounted on said frame member, said target member deforming from an initial position due to the article contacting said target member as the article moves along the path intersecting said target member;

a plurality of linear displacement sensors operatively connected to said target member at a plurality of points, each of said plurality of linear displacement sensors producing a signal in response to a corresponding one of said plurality of points moving as said target member deforms, said signal defining a time interval and a linear distance said corresponding point moves during said time interval; and a processor system for receiving and recording said signals from each of said plurality of linear displacement sensors and trigonometrically computing the position or velocity or both for the article at a selected time.

2. The backstop system of claim 1 wherein the target member is a flexible netting suspended on the frame.

3. The backstop system of claim 2 wherein the flexible netting has a plurality of corners, and the number of linear displacement sensors is at least three, each of the linear displacement sensors being operatively connected to the flexible netting adjacent one of said plurality of corners.

4. The backstop system of claim 3 wherein the netting is generally rectangular, the number of the plurality of corners is not more than four, and the number of the plurality of linear sensors is not more than four.

5. The backstop system of claim 1 wherein each of the plurality of linear displacement sensors comprises:

an axially-moveable member, said axially-moveable member being connected to the target member such that said axially-moveable member moves a distance along an axis when the target member deforms, said distance being generally equal to the distance the corresponding one of the plurality of points moves when the target member deforms; and an element for detecting the movement of said axially-moveable member relative to a predetermined reference position.

6. The backstop system of claim 5 wherein the axially-moveable member includes a plurality of indices and the element for detecting the movement of the axially-moveable member includes a light-emitting member and a detector member, said detector member being responsive to movement of said indices relative to said light-emitting member.

7. The backstop system of claim 6 wherein the indices include a plurality of spaced-apart recesses and projections on the axially-moveable member, said plurality of spaced-apart recesses and projections alternately passing and blocking a beam from the light-emitting member as the axially-moveable member moves relative to the predetermined reference position.

8. The backstop system of claim 7 wherein the plurality of spaced-apart recesses and projections are generally equidistantly spaced.

9. The backstop system of claim 5 wherein the target member is a netting and the axially-moveable member is operatively connected to said netting by a cord, said cord having opposing ends and being connected to said netting and the axially-moveable member at said opposing ends.

10. The backstop system of claim 5 wherein the axially-moveable member is a suspended counterweight.

11. The backstop system of claim 5 wherein the target member is a flexible netting and the axially-moveable member of each of the plurality of linear displacement sensors is a suspended counterweight which acts to absorb a portion of the kinetic energy of the projectile and return said flexible netting substantially to the initial position after sufficient kinetic energy has been dissipated.

12. The backstop system of claim 11 wherein the projectile passes a portion of the frame when traveling along the path intersecting the target member in a forward direction, and further wherein the axially-moveable member of each of the plurality of linear displacement sensors do not exert sufficient tension on the netting so as to cause the projectile to rebound in a backwards direction past said portion of the frame after the kinetic energy of the projectile in the forward direction has been substantially dissipated.

13. A method for determining the velocity or position or both of an article traveling along a path, said method comprising the steps of:

providing a frame member and a target member mounted on said frame member;

positioning said target member along the path such that the article contacts the target member and causes it to deform from an initial position due to the article contacting said target member;

measuring the time intervals during which a plurality of points on said target member move measured distances in response to the deformation of the target member; and trigonometrically computing the position or velocity or both for the article at a selected time based upon the measured time intervals and measured distances.

14. The method of claim 13 wherein the measured distances and the measured time intervals are determined by sensing the elapsed time interval between at least two moving indices of predetermined spacing passing a predetermined reference point.

15. The method of claim 13 wherein the target member is a flexible netting having a plurality of corners, and the step of measuring the time intervals during which the plurality of points on the target member move the measured distances in response to the deformation of the target member includes:

providing a plurality of linear displacement sensors, each of said plurality of linear displacement sensors being operatively connected to a one of the plurality of corners of the flexible netting and producing signals in response to movement of the corresponding one of the plurality of corners of the flexible netting; and receiving and recording the measured time intervals at which said signals are produced by each of said plurality of linear displacement sensors.

16. The method of claim 15 wherein each of the linear displacement sensors includes an axially-moveable member operatively connected to the target member and which moves along an axis in response to the deformation of the target member, and an element for detecting the movement of said axially-moveable member along said axis relative to a predetermined reference position.

17. The method of claim 13 wherein the position of the article at a given time is determined with reference to a predetermined plane through which the path of the article passes, said method further comprising the step of:

computing the trajectory of the article for at least some distance prior to the article intersecting the predetermined plane.

18. The method of claim 13 wherein the position of the article at a given time is determined with reference to a predetermined plane through which the path of the article passes, said method further comprising the step of:

forecasting the trajectory of the article for at least some distance subsequent to the article intersecting the predetermined plane.

* * * * *